US010011032B2

(12) United States Patent
Repac

(10) Patent No.: US 10,011,032 B2
(45) Date of Patent: Jul. 3, 2018

(54) FOOD COMMINUTION DEVICE

(71) Applicant: Genius GmbH, Limburg (DE)

(72) Inventor: Cedomir Repac, Brechen (DE)

(73) Assignee: Genius GmbH, Limburg (DE)

( * ) Notice: Subject to any disclaimer, the term of this patent is extended or adjusted under 35 U.S.C. 154(b) by 328 days.

(21) Appl. No.: 14/654,556

(22) PCT Filed: Dec. 20, 2013

(86) PCT No.: PCT/EP2013/077788

§ 371 (c)(1),
(2) Date: Jun. 22, 2015

(87) PCT Pub. No.: WO2014/102207

PCT Pub. Date: Jul. 3, 2014

(65) Prior Publication Data

US 2015/0367525 A1 Dec. 24, 2015

(30) Foreign Application Priority Data

Dec. 28, 2012 (DE) ..... 10 2012 224 517

(51) Int. Cl.
*B26D 3/18* (2006.01)
*B26D 3/26* (2006.01)
(Continued)

(52) U.S. Cl.
CPC ..... *B26D 3/185* (2013.01); *B26D 1/30* (2013.01); *B26D 3/18* (2013.01); *B26D 3/26* (2013.01);
(Continued)

(58) Field of Classification Search
CPC . B26D 3/18; B26D 3/185; B26D 3/26; B26D 2210/02; Y10S 83/932
(Continued)

(56) References Cited

U.S. PATENT DOCUMENTS 1,512,055 A * 10/1924 Rosenthal ..... A01C 1/005 83/425
2,166,624 A 7/1939 Cohn et al.
(Continued)

FOREIGN PATENT DOCUMENTS

CN 101927504 A 12/2010
CN 202357193 U 8/2012
(Continued)

OTHER PUBLICATIONS

English Translation of EP 2682240.*

*Primary Examiner* — Jennifer Swinney
(74) *Attorney, Agent, or Firm* — Hodgson Russ LLP

(57) ABSTRACT

The invention relates to a food comminution device which is designed to be placed on a worktop for a comminution operation, having an actuation part and having a base part which has a cutting part, wherein the base part and the actuation part are articulatedly connected such that the actuation part can, for pushing through food items to be comminuted, be pivoted from a loading position toward the cutting part into a closed position and subsequently from the closed position back into the loading position. The food comminution device is characterized in that the food comminution device has at least one drive device, in particular a spring drive, for assisting or effecting the pivoting movement from the closed position into the loading position and/or from the loading position into the closed position.

16 Claims, 7 Drawing Sheets

Figure 1:
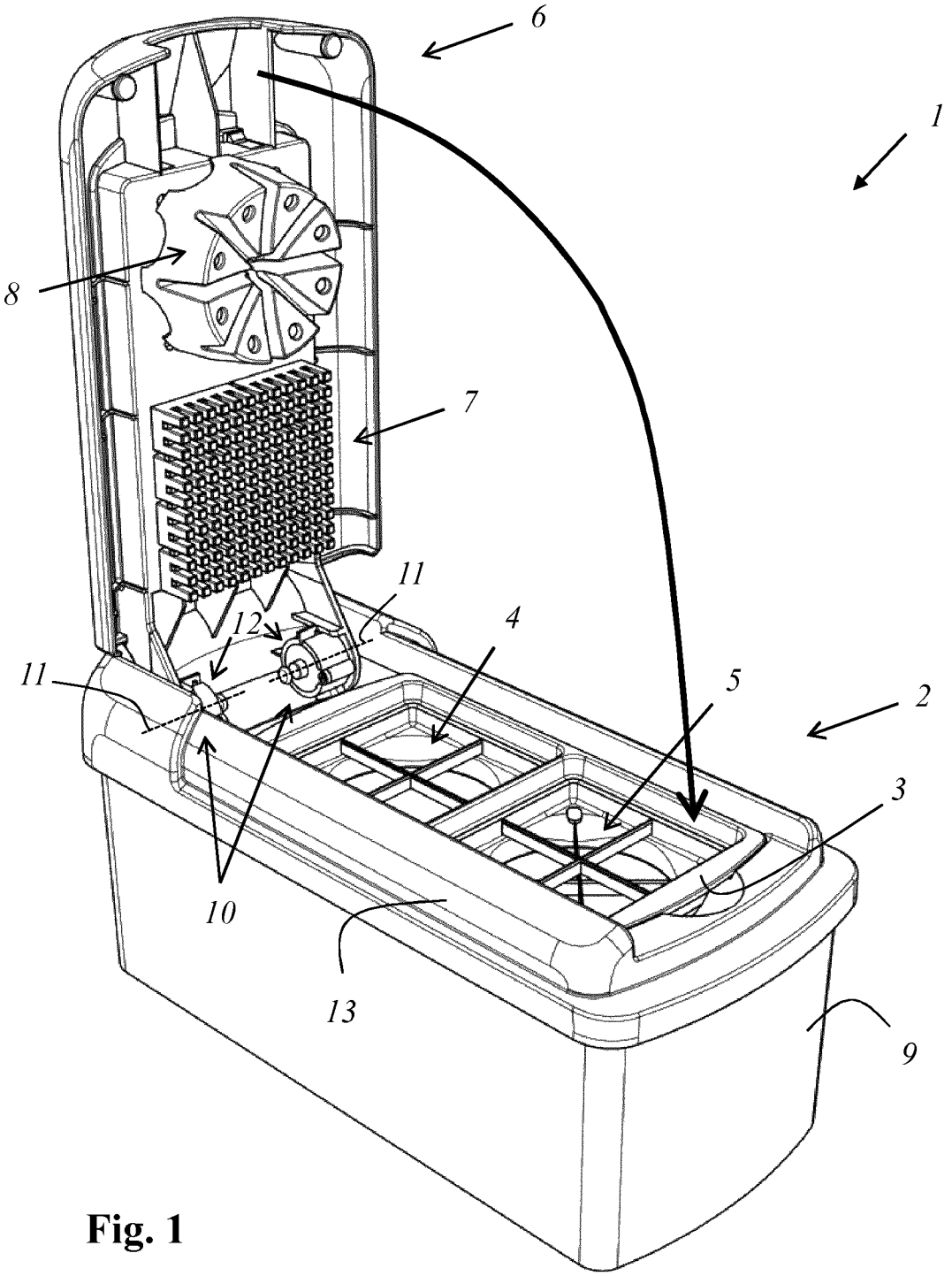

(51) Int. Cl.
*B26D 5/10* (2006.01)
*B26D 1/30* (2006.01)
*B26D 7/00* (2006.01)

(52) U.S. Cl.
CPC ..... *B26D 5/10* (2013.01); *B26D 7/00* (2013.01); *Y10T 83/222* (2015.04); *Y10T 83/8801* (2015.04)

(58) Field of Classification Search
USPC ..... 99/537
See application file for complete search history.

(56) References Cited

U.S. PATENT DOCUMENTS

| | | | | | |
|---|---|---|---|---|---|
| 2,258,096 | A * | 10/1941 | Martin | A01C 1/005 | 83/425 |
| 3,924,501 | A | 12/1975 | Cohen et al. | | |
| 5,692,424 | A * | 12/1997 | Wallace | A47J 36/00 | 83/167 |
| 6,244,150 | B1 * | 6/2001 | Holcomb | B26B 29/063 | 83/613 |
| 2009/0019705 | A1 | 1/2009 | Aby-Eva et al. | | |
| 2009/0158903 | A1 | 6/2009 | Yeung | | |
| 2012/0005861 | A1 | 1/2012 | Homner et al. | | |
| 2012/0055303 | A1 * | 3/2012 | Repac | B26D 3/185 | 83/167 |
| 2012/0102675 | A1 | 5/2012 | Lee et al. | | |

FOREIGN PATENT DOCUMENTS

| | | | | |
|---|---|---|---|---|
| DE | 87 00 035 | U1 | 4/1987 | |
| EP | 0079036 | A2 * | 5/1983 | H01R 13/447 |
| EP | 2135532 | A1 | 12/2009 | |
| EP | 2682240 | A1 * | 1/2014 | B26D 3/185 |
| GB | 331703 | | 4/1930 | |
| GB | 331703 | A * | 7/1930 | B62D 3/18 |
| GB | 471678 | | 3/1937 | |
| GB | 670925 | A * | 4/1952 | B62D 3/26 |
| WO | 2005/049947 | A1 | 6/2005 | |
| WO | 2011/057231 | A1 | 5/2011 | |
| WO | WO 2012079780 | A1 * | 6/2012 | B62D 3/185 |

* cited by examiner

FOOD COMMINUTION DEVICE

CROSS-REFERENCE TO RELATED APPLICATIONS

The present application is the U.S. national phase of International Application No. PCT/EP2013/077788 filed Dec. 20, 2013, which claims priority of German Application No. 10 2012 224 517.0 filed Dec. 28, 2012, the entirety of which is incorporated herein by reference.

FIELD OF THE INVENTION

The invention relates to a food comminution device which is designed to be placed on a worktop for a comminution operation, having an actuation part and having a base part which has a cutting part, wherein the base part and the actuation part are articulatedly connected such that the actuation part can, for pushing through food items to be comminuted, be pivoted from a loading position toward the cutting part into a closed position and subsequently from the closed position back into the loading position, wherein the food comminution device has at least one drive device, in particular a spring drive, for assisting or effecting the pivoting movement from the closed position into the loading position and/or from the loading position into the closed position.

BACKGROUND OF THE INVENTION

Food comminution devices of the type mentioned in the introduction are known in various embodiments for example from DE 10 2009 023 167 A1. Said document discloses in particular a device for cutting foodstuffs, such as fruit and vegetables, having a cutting part which has multiple cutting edges, and having an actuation part, said cutting part and actuation part being mounted so as to be pivotable relative to one another. To cut the items for cutting, the actuation part is pushed toward the cutting part, wherein the actuation part has a plunger which pushes the items for cutting through the cutting part, wherein the cutting edges protrude into corresponding depressions of the plunger. The cutting part has a cutting frame in which cutting blades are held. The device furthermore has a cover part for mounting on a receiving container for the cut items, wherein the cover part has an opening which forms a passage for the cut items.

The known devices have the particular advantage that even relatively large quantities of food items for comminution can be processed without great effort. There is the advantage in particular that the user, when pushing through the items for comminution, can also use their body weight to assist them, by supporting themselves on the actuation part during the pivoting of the actuation part toward the cutting part.

After the comminution process has been completed, the actuation part must be manually transferred back into the loading position, wherein the user uses one hand to pivot the actuation part from the closed position back into the loading position, while having to use their other hand to hold the base part stationary. If the base part were not held stationary during the pivoting of the actuation part back into the loading position, the entire base part, possibly together with the container coupled thereto, would lift from the worktop. This can be attributed to the fact that, in the case of any comminution process, the actuation part will inevitably become jammed with the cutting part to a certain degree owing to residues of items for comminution which are situated laterally between the cutting blades and the walls of the slots in the pressing plunger. Even without this jamming effect, it is difficult to pivot the actuation part back into the loading position without inadvertently simultaneously displacing the base part together with the container along the worktop. For this reason, too, it is necessary to hold the base part stationary when the actuation part is being pivoted back.

U.S. Pat. No. 2,258,096 discloses a food comminution device having a base part which has fold-out support legs and a cutting part. An actuation part which is articulatedly and non-detachably connected to the base part can be pivoted from a loading position into a closed position and vice versa. A spring that is anchored in the base part effects the pivoting movement from the closed position into the loading position.

DE 87 00 035 U1 discloses a cutting implement which is composed of two arms of tongs which are articulatedly connected at their rear end and which can be pushed together counter to the action of a restoring spring. One arm of the tongs bears, at the front end, a cutting grid which is oriented toward a receiving depression on the other arm of the tongs. The receiving depression has a rounded trough shape suitable for receiving a mushroom positioned on the head. The cutting grid is composed of sharpened stainless steel blades and the two arms of the tongs have, at the front, handle projections which project beyond the cutting grid and the receiving depression respectively. By way of said handle projections, the arms of the tongs can be additionally gripped and pushed together using the second hand. Furthermore, the cutting implement can be locked in the closed position by means of a hinge blocking mechanism.

A similar product is disclosed in document U.S. Pat. No. 2,166,624, said product having no means for locking in a closed position.

US 2009/0158903 A1 discloses a device for the comminution of foodstuffs, which device has a manually operable drive device which cannot be deactivated. The drive device comprises two gearwheels which transmit the drive power imparted by the user to the comminution element of the device.

SUMMARY OF THE INVENTION

It is the object of the present invention to specify a food comminution device of the type mentioned in the introduction with which it is possible to work more quickly and more efficiently.

The object is achieved by means of a food comminution device which is characterized in that the articulated connection is designed such that the actuation part, at least in a particular pivoting position, in particular in the loading position, is detachable from the base part.

The food comminution device according to the invention has in particular the very special advantage that it can be operated using one arm. It may for example be provided that the user uses one hand to place items for comminution onto the cutting part and subsequently uses the other hand to pivot the actuation part toward the cutting part and thus stress a spring of a drive device which is in the form of a spring drive. Under the action of the force imparted by the stressed spring, the actuation part can, after the comminution process has taken place, move back automatically—that is to say without the user having to hold the base part with one hand—from the closed position into the loading position again. The user can consequently use one hand exclusively for placing further items for comminution onto the cutting part after every comminution process, while using the other hand exclusively for pivoting the actuation part from the loading position into the closed position.

In this way, it is possible for a significantly greater quantity of food items to be processed in the same length of time, because the procedures can be carried out very much more quickly and without the user having to change their grip, which is inconvenient and time-consuming.

By virtue of the fact that the articulated connection is designed such that the base part is easily detachable, preferably without the aid of a tool, from the actuation part, the base part and the actuation part can advantageously be separated from one another for a cleaning process, for example. A further advantage lies in the fact that the actuation part can also, if necessary, be exchanged for a different actuation part, for example with a different pressing plunger for a different cutting part.

In one advantageous embodiment, it is provided that the drive device is selectively activatable or deactivatable and/or that the assistance force of the drive device is adjustable.

Such an embodiment has the advantage that it can be adjusted, in accordance with the type of items for comminution, such that a fast and efficient comminution process is always made possible.

A deactivation is preferably realized by virtue of the actuation part being freely pivotable relative to the base part when the drive device is deactivated. It may however also be provided that a deactivation is realized by virtue of pivoting of the actuation part relative to the base part no longer being possible.

For example, in the case of a food comminution device in which the drive device has at least one spring which is placed under stress during the pivoting of the actuation part from the loading position into the closed position and which relaxes so as to assist the pivoting movement of the actuation part from the closed position into the loading position, a deactivation of the drive device may be realized if particularly hard foods are to be comminuted, for which purpose the user requires their full force in any case. This prevents a situation in which the user must additionally impart additional energy for placing the spring under stress during the pivoting of the actuation part from the loading position into the closed position.

By contrast, for the comminution of foodstuffs which can be pushed through the cutting part by means of the actuation part with little expenditure of force, the drive may be activated; for example in order to assist or automatically effect the pivoting of the actuation part from the closed position into the loading position.

In the case of a food comminution device in which the assistance force of the drive device is adjustable, it is advantageously possible, for example in a manner dependent on the cuttability of the foodstuff, for an intermediate setting between full deactivation and full activation to be selected.

In a very particularly advantageous embodiment, it may advantageously be provided that multiple, in particular precisely two, drive devices and multiple, in particular precisely two, coupling devices are provided, and that each of the drive devices is selectively activatable or deactivatable in each case by means of one coupling device. In particular, it may advantageously be provided that the multiple drive devices are activatable or deactivatable independently of one another.

Such an embodiment has the very special advantage that assistance or generation of the pivoting movement can be fully eliminated through deactivation of all drive devices, that maximum assistance or generation of the pivoting movement can be realized through activation of all drive devices, and, furthermore, that an intermediate setting can be realized through activation of only some of the drive devices.

In a very particularly advantageous embodiment, the food comminution device has two joints which are arranged mirror-symmetrically with respect to one another and which have coaxial pivot axes and which serve for the articulated coupling of the actuation part to the base part. In this case, it may be provided in particular that each of the joints has a drive device, or that a dedicated drive device is installed at each of the joints. It is preferably also the case that the drive devices are constructed and arranged mirror-symmetrically relative to one another.

In a particular embodiment, the drive device is selectively activatable or deactivatable by means of a switchable coupling device. In particular, it may be provided that mechanical coupling of the drive device to the base part and/or to the actuation part can be effected, for example through the production of a positively locking connection or a frictionally locking connection, by means of the coupling device.

In a particular embodiment, the coupling device has a coupling element which can be transferred into either a coupling position or a decoupling position, wherein mechanical, in particular positively locking and/or rotationally conjoint, coupling of a spring of the drive device to the base part or to the actuation part is effected by the coupling element in the coupling position, and the mechanical coupling is eliminated in the decoupling position. In particular, it may be provided that one end and/or one leg of the spring is fixedly connected to the actuation part, whereas the other end and/or the other leg of the spring can be selectively coupled to the base part by means of the coupling element. It is self-evidently also conversely possible for one end and/or one leg of the spring to be fixedly connected to the base part, whereas the other end and/or the other leg of the spring can be selectively coupled to the actuation part by means of the coupling element.

In particular, it may advantageously be provided that the coupling element, when in the coupling position, engages into a recess of the base part or of the actuation part and, in the decoupling position, is arranged outside the recess.

In particular if a torque imparted by the drive unit is to be transmitted so as to assist or effect the pivoting movement, it may advantageously be provided that the coupling element, when in the coupling position, is arranged so as to be non-rotatable relative to the recess, into which it engages, of the base part or of the actuation part. This may be achieved for example in that the coupling element is of non-circular, in particular polygonal, form in cross section and, in the coupling position, engages into a corresponding non-circular, in particular polygonal, recess of the base part or of the actuation part.

In a particular embodiment, the coupling element is in the form of an in particular linearly displaceable slide. In this case, it may be provided in particular that said slide, in order to effect the coupling position, can be slid, in particular in positively locking and/or non-rotatable fashion, into a recess of the base part or of the actuation part, and in order to effect the decoupling position, is pulled out of the recess of the base part or of the actuation part.

In an advantageous embodiment, which makes it possible in particular for the drive device or the drive devices to be accommodated in a particularly space-saving manner and in a position which does not disrupt the comminution process, it is provided that the articulated connection is formed by at least one joint, in particular a hinged joint, with a joint head and a joint head receptacle, wherein at least one component of the drive device is part of the joint. It may alternatively or additionally also be provided that the drive device is arranged in the region of the joint, and/or can be mechanically coupled to parts of the joint in order to effect the coupling position.

In a particular embodiment, the recess into which the coupling element can engage is arranged in one part of the articulated connection, in particular in a joint head or in a joint head receptacle.

In the case of such an embodiment in particular, it may for example be provided that the coupling element is arranged, in particular movably, in a part of the articulated connection, in particular in a joint head or in a joint head receptacle, and/or that the coupling element forms a part of the articulated connection, in particular a joint head.

In a particularly reliable and compact embodiment, the coupling element, which is for example in the form of a slide, is arranged on the pivot axis of the articulated connection. In particular, it may be provided here that the coupling element is guided so as to be displaceable along the pivot axis of the articulated connection.

In a particular embodiment, the actuation part has a joint head receptacle into which a joint head, which is for example in the form of a peg, of the base part can be received for the purpose of binding the articulated connection. Furthermore, in this embodiment, the joint head receptacle preferably has a guide for a coupling element which is in the form of a slide and which can be displaced along the pivot axis of the articulated connection either into a coupling position or into a decoupling position. In the coupling position, a free end of the slide engages rotationally fixedly into a recess of the joint head and thus couples a spring which is fixed to the actuation part, in particular a spiral spring or helical spring or a leg spring, to the base part. As the actuation part pivots relative to the base part, the spring is placed under stress, and energy for the return pivoting movement is stored.

In this case, it may be provided in particular that the spring is at least partially in the form of a spiral spring which concentrically surrounds the pivot axis, wherein the outer end of the spiral spring is fixed to the actuation part, whereas the inner end of the spiral spring is arranged in a longitudinal slot of the coupling element which is in the form of a slide. In this way, it is made possible for the slide to be displaceable along the pivot axis without bending the spiral spring.

It is also possible for the spring to be in the form of a helical spring, wherein one end of the helical spring is arranged in linearly displaceable fashion in a longitudinal slot of the coupling element which is in the form of a slide, whereas the other end is fixed to the actuation part.

To effect rotationally rigid coupling of the coupling element to the base part, provision may be made, as already discussed, for the coupling element to be of non-circular form in cross section at its free end, such that it cannot rotate in the correspondingly formed receptacle.

In a very particularly advantageous embodiment, the articulated connection is designed such that the actuation part, at least in a particular pivoting position, in particular in the loading position, is detachable from the base part, exclusively by virtue of the actuation part and base part being pulled apart. Such an embodiment has the very particular advantage that the base part and the actuation part can, for example for a cleaning process, be separated from one another easily and preferably without the aid of a tool. A further advantage of such an embodiment lies in the fact that the actuation part can also, if necessary, be exchanged for a different actuation part, for example with a different pressing plunger for a different cutting part.

Tool-free separability of the base part and actuation part may for example be realized by virtue of the joint head receptacle having a radial opening through which the joint head can be removed from or inserted into the joint head receptacle in a radial direction.

In a very particularly advantageous embodiment, the articulated connection is designed such that the actuation part, at least in a particular pivoting position, in particular in the loading position, is detachable from the base part, in particular exclusively by virtue of the actuation part and base part being pulled apart, regardless of whether the drive device is activated or deactivated and/or regardless of whether the coupling element is situated in the coupling position or in the decoupling position.

This may be achieved for example by virtue of the receptacle having an additional, in particular radially oriented opening through which the coupling element can be removed from the receptacle preferably in a radial direction, that is to say perpendicular to the pivot axis. In the case of such a design, it is accordingly not necessary for the coupling element to initially be transferred into the decoupling position and thus removed from the receptacle in order to permit a detachment of the actuation part from the base part. Rather, as already mentioned, the coupling element can be removed from the receptacle through the additional opening.

As already mentioned, it may advantageously be provided that the activated drive device is supported, on the one hand, on the base part and, on the other hand, on the actuation part, and/or that the activated drive device acts and/or is arranged between the base part and the actuation part.

As already mentioned, it may advantageously be provided that the articulated connection is formed by at least one joint, in particular a hinged joint, with a joint head and a joint head receptacle.

In particular, it may advantageously be provided that the base part, on the one hand, has at least one joint head and the actuation part, on the other hand, has a corresponding joint head receptacle for forming an articulated connection, or that the actuation part, on the one hand, has at least one joint head and the base part, on the other hand, has a corresponding joint head receptacle for forming an articulated connection.

In the case of such a device, it may advantageously be provided that the activated drive device is supported, at the one hand, on the joint head and, on the other hand, on the joint head receptacle. It may alternatively or additionally also be provided that the drive device is arranged on and/or in the joint and/or that at least one component of the drive device is part of the joint.

As has likewise already been mentioned, the drive device may have at least one spring, in particular a spiral spring or a helical spring or a leg spring. The drive device may alternatively or additionally also have a gas pressure spring. The drive device may also be in the form of an electromotive drive device.

In a particular embodiment, the drive device has at least one spring which is placed under stress during the pivoting of the actuation part from the loading position into the closed position and which relaxes so as to assist the pivoting movement of the actuation part from the closed position into the loading position. It is alternatively also possible for the drive device to have at least one spring which is placed under stress during the pivoting of the actuation part from the closed position into the loading position and which relaxes so as to assist the pivoting movement of the actuation part from the loading position into the closed position. In a particular embodiment, switching between the two above-mentioned operating modes is possible.

According to the invention, the device is designed to be placed on a worktop for a comminution process. For example, the device may have a stand, for example with supporting feet, for placing on a worktop. In particular, a container for collecting the comminuted foodstuff may also be designed, and function, as a stand.

The device may advantageously be in the form of a cover which can be mounted on a container—preferably so as to completely cover the container opening—and/or can be fixed to a container. The comminuted foodstuff can in this way be safely and reliably collected in the container. In particular, in this way, it is also realized that undesired articles are prevented from passing into the meal in the container. This applies in particular in the case of multiple meals being prepared simultaneously in a kitchen area. Furthermore, removal of the device after use is not necessary in order to attach a separate cover. This applies in particular in the case of short time intervals between periods of use of the device.

In a particular embodiment, the base part is in the form of a container for the comminuted foodstuff. Furthermore, a container of said type may also be in the form of a stand for enabling the food comminution device to be placed on a worktop.

However, regardless of whether or not the base part is also in the form of a container, it may also advantageously be provided that the base part is additionally in the form of a stand for enabling the food comminution device to be placed on a worktop or has a stand for enabling the food comminution device to be placed on a worktop.

What is very particularly advantageous is a kitchen appliance which has a container for collecting the comminuted items and a food comminution device according to the invention which is designed as a cover for the container. In this case, it may advantageously be provided in particular that the food comminution device in the form of a cover can be mounted on the container so as to completely cover the container opening. In particular, it may additionally be provided that, for a comminution process, the food comminution device can be fixed temporarily to the container edge, for example by way of a screw connection or by way of a detent connection.

It may for example be provided that the container is in the form of a stand for enabling the food comminution device to be placed on a worktop. For example, supporting feet, in particular non-slip supporting feet composed of rubber or some other elastic material, may be arranged on the outer side of the base of the container.

BRIEF DESCRIPTION OF THE DRAWING VIEWS

Figure 2:
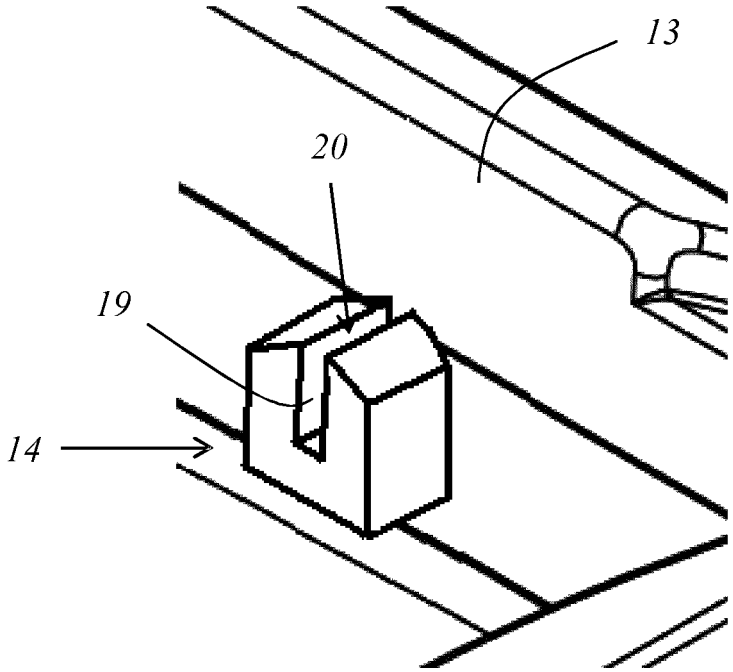
Figure 3:
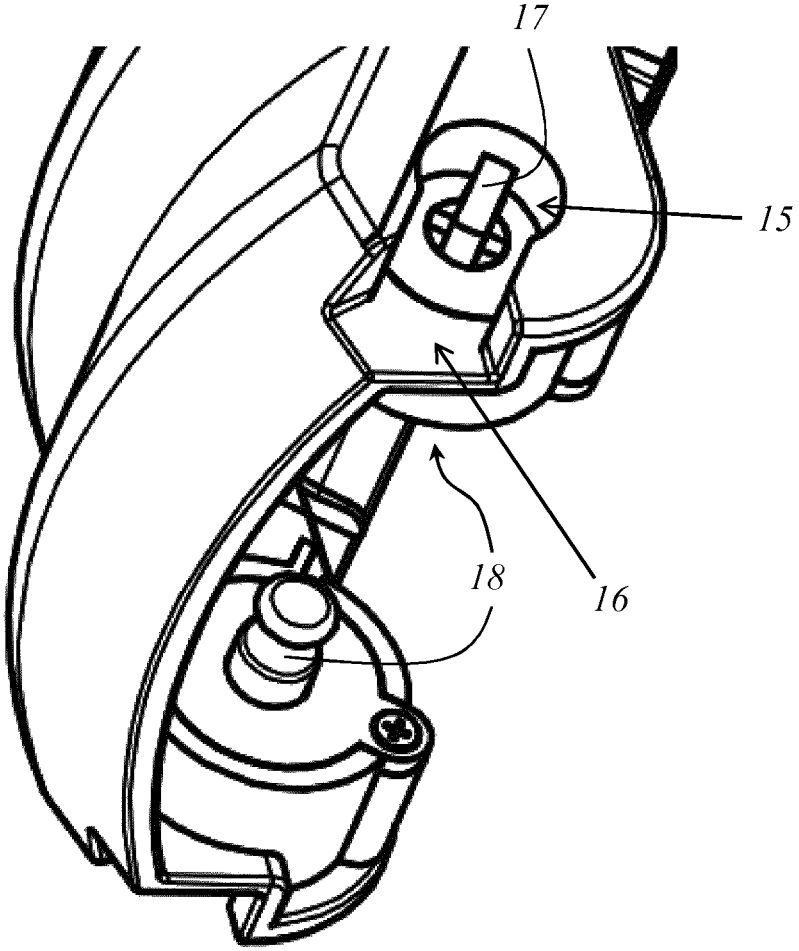
Figure 4A:
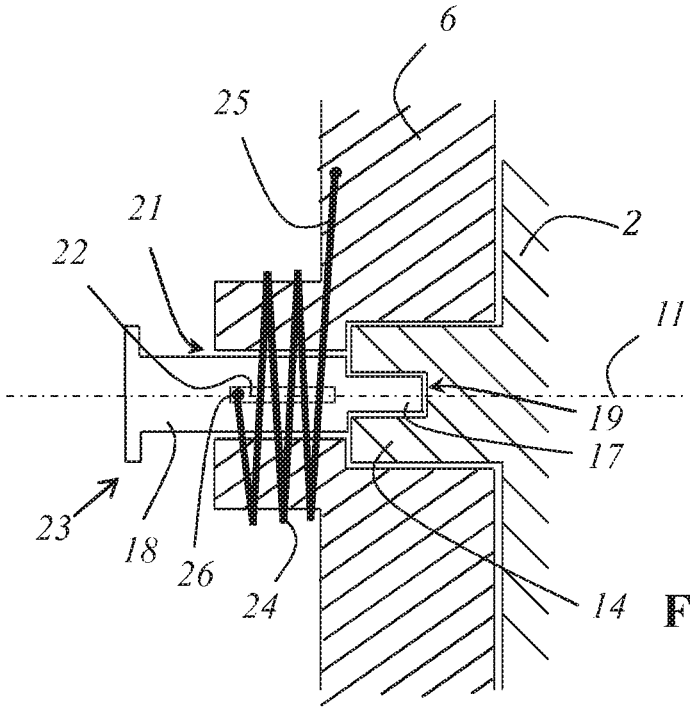
Figure 4B:
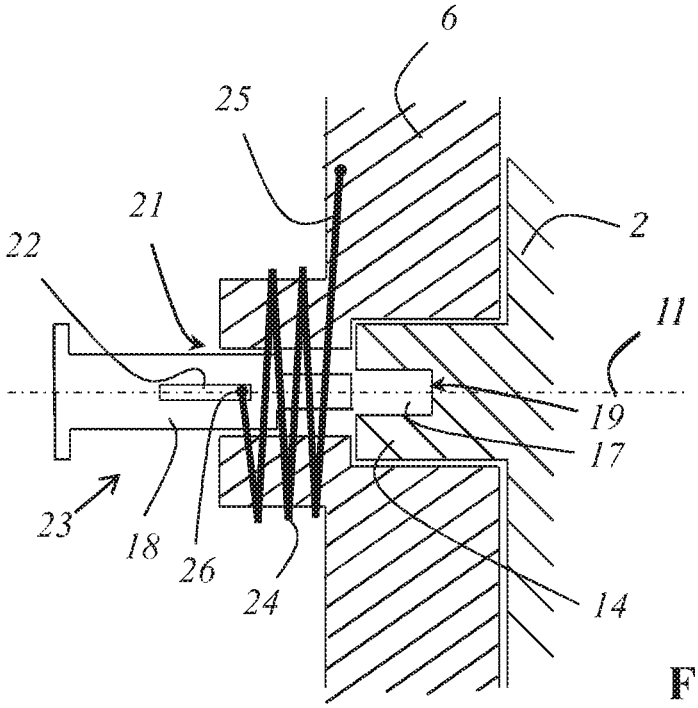
Figure 5:
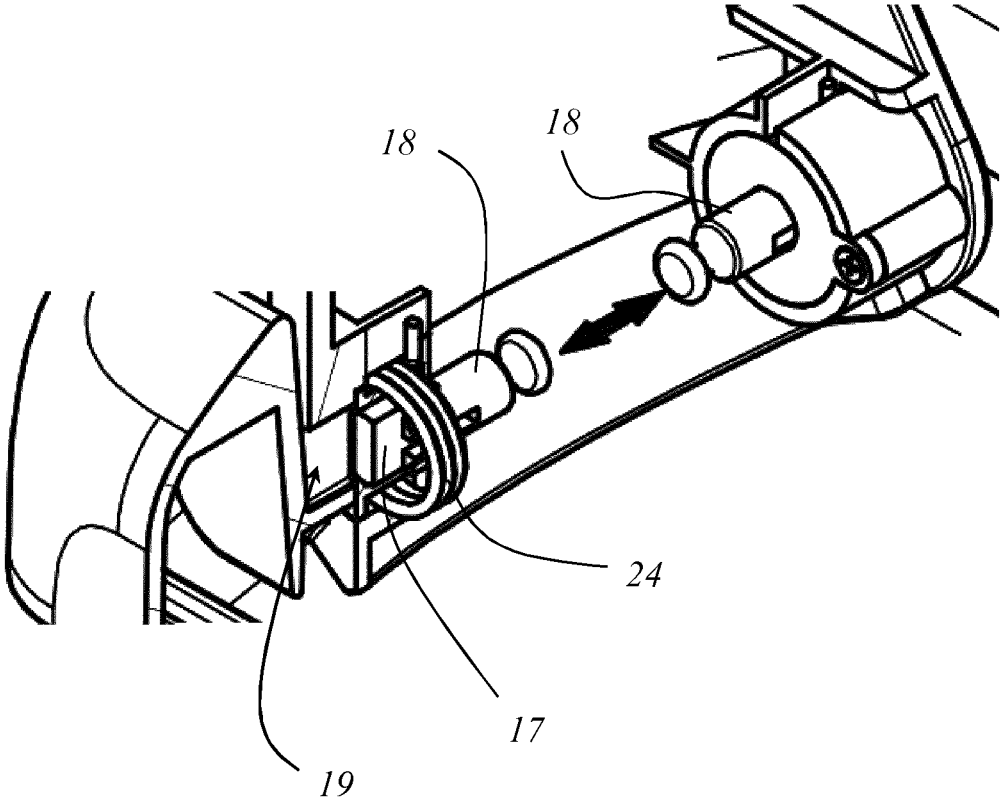

The subject matter of the invention is schematically illustrated in the drawing and will be described below on the basis of the figures, wherein identical elements or elements of identical action are normally denoted by the same reference signs. In the drawing:

FIG. 1 shows an exemplary embodiment of a food comminution device according to the invention in a perspective view, FIG. 2 shows a detail view of a joint head, FIG. 3 shows a detail view of the joint head receptacles and of the drive devices, FIG. 4 shows two diagrammatic illustrations which illustrate the activation and deactivation of a drive device, FIG. 5 shows a detail view of the joints and of the drive devices, FIG. 6 shows the actuation part with the drive device activated and deactivated, and FIG. 7 shows detail views of the joints and of the drive devices in the activated state and in the deactivated state.

DETAILED DESCRIPTION OF THE INVENTION

FIG. 1 shows an exemplary embodiment of a food comminution device 1 according to the invention which has a base part 2 with a receptacle for an exchangeable cutting part 3. In the exemplary embodiment illustrated, the cutting part 3 comprises a first cutting region 4 and a second cutting region 5, wherein the cutting regions 4, 5 each have different cutting blade arrangements.

The food comminution device 1 furthermore has an actuation part 6 which is articulatedly connected to the base part 2 such that, for pushing through foodstuffs for comminution, said actuation part can be pivoted from the illustrated loading position, in which items for comminution can be placed onto the cutting part 3, toward the cutting part 3 into a closed position (not illustrated), as indicated by the curved arrow in the figure.

The actuation part 6 has a first pressing plunger 7 and a second pressing plunger 8. The first pressing plunger 7 serves for pushing a foodstuff that has been placed onto the first cutting region 4 of the cutting part 3 through the first cutting region 4, wherein the foodstuff is cut into pieces by the cutting blades of the first cutting region 4. The second pressing plunger 8 serves for pushing a foodstuff that has been placed onto the second cutting region 5 of the cutting part 3 through the second cutting region 5, wherein the foodstuff is cut into pieces by the cutting blades of the second cutting region 5.

After being cut into pieces, the foodstuff falls into a container 9, which simultaneously serves as a stand for enabling the food comminution device 1 to be placed on a worktop (not illustrated). The food comminution device 1 is in the form of a cover which can be mounted onto the container 9 with detent action and so as to completely cover the container opening. After all of the foodstuff for processing has been pushed through the cutting part 3, the food comminution device 1 can be removed from the container 9, for example in order for the container 9 to be emptied.

The base part 2 has a frame 13 which provides the receptacles for the cutting part 3. Furthermore, the base part 2 has two joint heads 14 (illustrated in detail in FIG. 2) which, in interaction with the joint head receptacles 15 of the actuation part 6, permit an articulated coupling of the actuation part 6.

In the exemplary embodiment illustrated, the articulated connection of the actuation part 6 to the base part 2 is formed by two joints 10 which are of mirror-symmetrical construction and which are arranged mirror-symmetrically with respect to one another. The joints 10 are in the form of hinged joints with mutually coaxial pivot axes 11, and will be described in more detail below.

In the region of each of the joints 10 there is arranged in each case one drive device 12 for assisting or effecting the pivoting movement from the closed position into the loading position, which drive devices will likewise be described in more detail below.

FIG. 2 shows a detail view of one of the joint heads 14 arranged on the inner side of the frame 13. The joint head 14 is substantially in the form of a peg which projects inward from the frame 13 and which has parallel walls such that a joint head receptacle 15 of the actuation part 6, as can be seen in FIG. 3, can be pushed on. For this purpose, the joint head receptacles 15 each have a radial opening 16, which radial openings enable the actuation part 2 to be pushed onto the joint heads 14 in the loading position. The width of the joint heads 14 is selected specifically such that they fit through the radial openings 16 of the joint head receptacles 15, but they can no longer exit the joint head receptacles 15 when the actuation part 6 has been pivoted from the loading position into a different pivoting position. In this way, it is ensured that the actuation part 2 does not inadvertently become detached during the comminution process.

As will be presented in detail below, an activation of the drive device 11 is realized in each case by virtue of the free end 17 of a slide 18 being slid rotationally fixedly into a recess 19 of the joint head 14. A co-rotation of the slide 18 in the coupled position is prevented by virtue of the free end 17 of the slide 18 and the recess 19 being of non-circular form, in the present example cuboidal. For the deactivation of the drive device 11, the slide 18 is pulled out of the recess 19 again.

To enable the actuation part 6 to be detached from the base part 2 in the loading position even when the slide 18 is in the coupled position, the recess 19 and the joint heads 14 likewise define radially-facing openings 20 which make it possible for the free ends 17 of the slides 18 to be pulled out of the recesses 19 perpendicularly to the pivot axes 11. By means of this configuration, it is advantageously achieved that the actuation part 6 can be detached from the base part 2 regardless of the position of the slides 18. Accordingly, the user is not forced to deactivate the drive devices 12 before being able to detach the actuation part 6 from the base part 2, for example for a cleaning process.

FIGS. 4*a* and 4*b* each show a joint 10 which is formed from a joint head receptacle 15 of an actuation part 6 and a joint head 14 of a base part 2, and illustrate the principle of the activation and deactivation of the drive device 12, which is in the form of a helical spring 24.

The joint 10 makes it possible for the actuation part 6 to be pivoted relative to the base part 2 about a pivot axis 11. In the actuation part 6 there is provided a linear guide 21 in which a coupling element 23, which is in the form of a slide 18, is guided in linearly displaceable fashion along the pivot axis 11.

The helical spring 24 concentrically surrounds the pivot axis 11, the linear guide 21 and the slide 18. A first end 25 of the helical spring 24 is in the form of a leg, and is fixed to the actuation part 6. The other end 26 of the helical spring 24 is bent at an angle and is guided in linearly displaceable fashion in a longitudinal slot 22 of the slide 18.

The free end 17 of the slide 18 is in a non-circular, specifically cuboidal, form and, in the coupling position as shown in FIG. 4*a*, engages in positively locking fashion into a cuboidal recess 19 of the joint head 15. In said coupling position, the helical spring 24 is placed under stress when the actuation part 6 is pivoted relative to the base part 2, for example during the movement from the loading position into the closed position. During the opposite pivoting movement, the helical spring 24 relaxes and thus effects or assists the opposite pivoting movement, for example from the closed position into the loading position.

To deactivate the drive device, the free end 17 of the slide 18 is pulled out of the recess 19. This is illustrated in FIG. 4*b*. In this decoupled position, the actuation part 6 can be pivoted relative to the base part 2 without the helical spring 24 being placed under stress. Rather, in this decoupled position, the coupling element 23 can co-rotate freely with the actuation part 6.

FIG. 5 shows, in a perspective illustration, the principle of the activation and deactivation of the drive device 12 which has the helical spring 24. It can be clearly seen that the left-hand drive device 12 is deactivated because the free end 17 of the slide 18 has been pulled out of the recess 19.

Figure 6A:
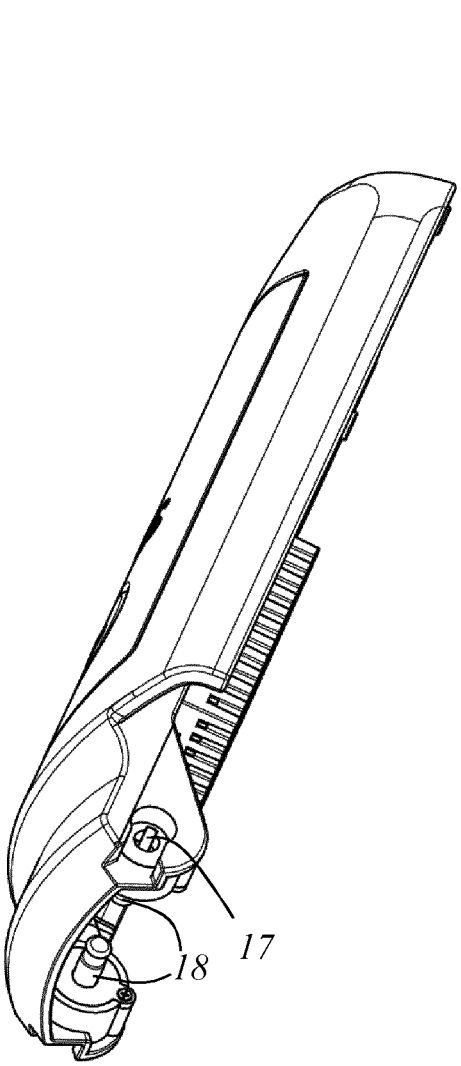
Figure 6B:
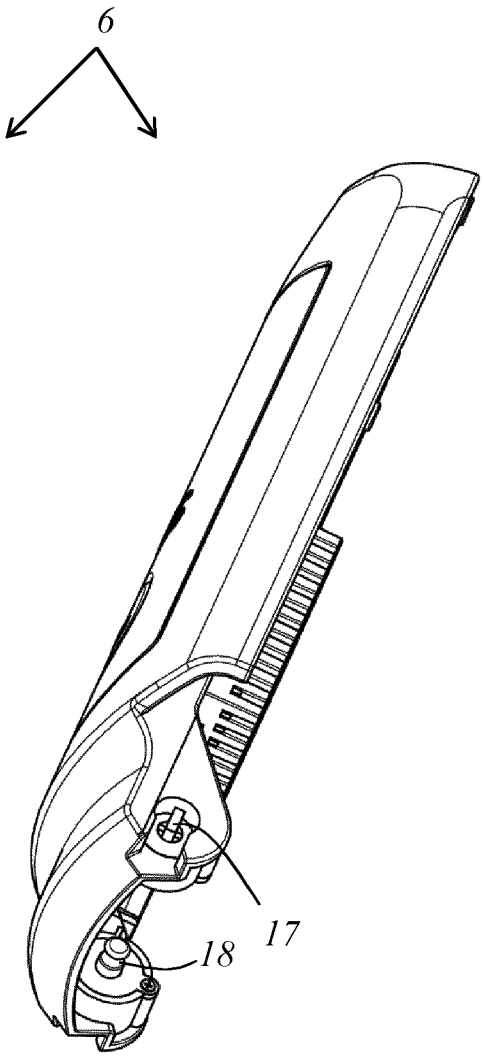

FIGS. 6*a* and 6*b* each show an actuation part 6, and illustrate the position of the free ends 17 of the slides 18. In the case of the actuation part 6 illustrated in FIG. 6*a*, the free end 17 is situated in a retracted position in which it does not engage into a recess 19 of the base part 2. In this position, the drive device 12 is deactivated.

In the case of the actuation part 6 illustrated in FIG. 6*b*, the free end 17 is situated in an advanced position in which it engages into a recess 19 of the base part 2. In this position, the drive device 12 is activated.

Figures 7A, 7B:
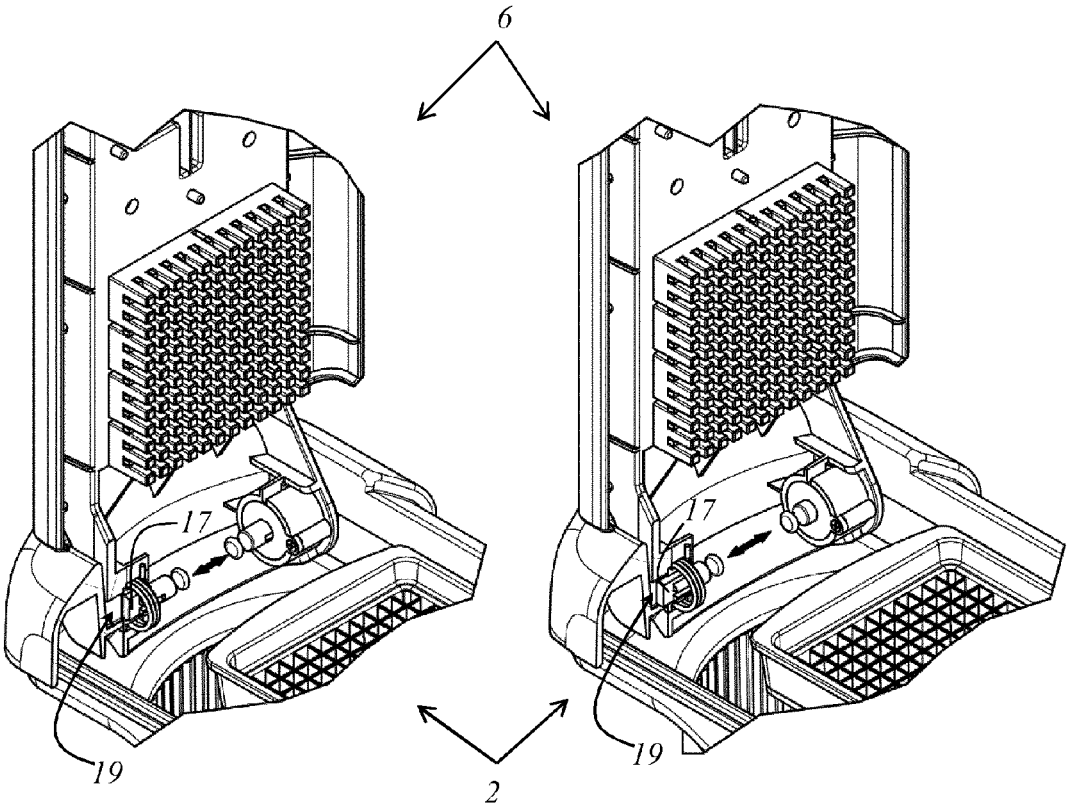

In the setting illustrated in FIG. 7*a*, the drive device 12 of the left-hand joint 10 is deactivated, because the free end 17 of the slide 18 is not engaged into the corresponding recess 19 of the actuation part 6.

In the setting illustrated in FIG. 7*b*, the drive device 12 of the left-hand joint 10 is activated, because the free end 17 of the slide 18 is engaged into the corresponding recess 19 of the actuation part 6.

LIST OF REFERENCE NUMERALS

1 Food comminution device
2 Base part
3 Cutting part
4 First cutting region
5 Second cutting region
6 Actuation part
7 First pressing plunger
8 Second pressing plunger
9 Container
10 Joints
11 Pivot axes
12 Drive devices
13 Frame
14 Joint heads
15 Joint head receptacles
16 Radial openings in the joint head receptacles
17 Free end
18 Slide
19 Recess
20 Radial openings in the joint heads
21 Linear guide
22 Longitudinal slot
23 Coupling element
24 Helical spring
25 First end of the helical spring
26 Other end of the helical spring

What is claimed is:

1. A food comminution device (1) comprising:

a base part (2) including a cutting part (3);

an actuation part (6) articulatedly connected to the base part (2), wherein the actuation part (6) is pivotable toward the cutting part (3) from a loading position into a closed position to push food items to be comminuted through the cutting part (3), and is pivotable from the closed position back into the loading position; and a drive device (12) for pivotally urging the actuation part; and a coupling element to which the drive device is operably connected, wherein the coupling element is slideable along an axis between a coupling position and a decoupling position, and when the coupling element is in the coupling position, an end of the coupling element is received in a corresponding recess of the base or the actuation part to positively lock the coupling element to the base part or the actuation part, and when the coupling element is in the decoupling position the end of the coupling element is decoupled from the recess;

wherein the actuation part is rotatable relative to the base when the coupling element is in either the coupling position or the decoupling position, and the actuation part (6) is detachable from the base part (2) when the actuation part (6) is in the loading position.

2. The food comminution device (1) according to claim 1, wherein the coupling element (23) is movable into a coupling position to selectively activate the drive device (12) and into a decoupling position to selectively deactivate the drive device (12).

3. The food comminution device (1) according to claim 2, the actuation part pivots relative to the base part about the axis along which the coupling element slides.

4. The food comminution device (1) according to claim 2, wherein the end of the coupling element (23) includes a non-circular free end (17) received in a correspondingly shaped recess (19) of the base part (2) or of the actuation part (6) when the coupling element (23) is in the coupling position.

5. The food comminution device (1) according to claim 4, wherein the recess (19) is in the base part (2) and the actuation part (6) pivots relative to the coupling element (23) and the base part (2) when the coupling element (23) is in the coupling position.

6. The food comminution device (1) according to claim 5, wherein the drive device (12) includes a spring (24) having a first end (25) fixed to the actuation part (6) and a second end (26) fixed to the coupling element (23).

7. The food comminution device (1) according to claim 6, wherein the spring (24) is placed under stress by pivotal motion of the actuation part (6) relative to the base part (2) when the coupling element (23) is in the coupling position, and the spring (24) is not placed under stress by pivotal motion of the actuation part (6) relative to the base part (2) when the coupling element (23) is in the decoupling position, whereby the drive device (12) is selectively activatable by moving the coupling element (23) into the coupling position and the drive device (12) is selectively deactivatable by moving the coupling element (23) into the decoupling position.

8. The food comminution device (1) according to claim 5, wherein the base part (2) includes a joint head (14) and the actuation part (6) includes joint head receptacle (15) into which the joint head (14) is received, whereby the actuation part (6) is articulatedly connected to the base part (2) to pivot about a pivot axis (11).

9. The food comminution device (1) according to claim 8, wherein the joint head receptacle (15) includes a radial opening (16) through which the joint head (14) is removed from or inserted into the joint head receptacle (15) in a radial direction relative to the pivot axis (11), whereby the actuation part (6) is manually detachable from and attachable to the base part (2).

10. The food comminution device (1) according to claim 9, wherein the radial opening (16) and the joint head (14) are configured such that the actuation part (6) must be in the loading position to allow the joint head (14) to be removed from or inserted into the joint head receptacle (15).

11. The food comminution device according to claim 9, wherein the recess (19) defines a radially-facing opening (20) through which the coupling element (23) can be removed from the recess (19) to allow manual detachment of the actuation part (6) from the base part (2) when the coupling element (23) is in the coupling position.

12. The food comminution device according to claim 8, comprising a pair of joint head receptacles (15) and a corresponding pair of joint heads (14) forming a pair of hinged joints (10) by which the actuation part (6) is articulatedly connected to the base part (2).

13. The food comminution device (1) according to claim 1, wherein the food comminution device comprises precisely two of the drive devices (12), wherein the two drive devices (12) are activatable or deactivatable independently of one another.

14. The food comminution device according to claim 1, further comprising a container (9) for receiving the comminuted food items, wherein the base part (2) is removably attachable to the container (9).

15. The food comminution device according to claim 1, wherein the base part (2) is in the form of a container (9) for the comminuted food items.

16. The food comminution device according to claim 1, wherein the base part (2) includes a stand for enabling the food comminution device (1) to be placed on a worktop.

* * * * *